US007520023B2

(12) United States Patent
Hirtsiefer

(10) Patent No.: US 7,520,023 B2
(45) Date of Patent: Apr. 21, 2009

(54) HINGE

(75) Inventor: Artur Hirtsiefer, Neunkirchen-Seelscheid (DE)

(73) Assignee: Huwil-Werke GmbH Mobelschloss und Beschlagfabriken, Ruppichteroth (DE)

( * ) Notice: Subject to any disclaimer, the term of this patent is extended or adjusted under 35 U.S.C. 154(b) by 23 days.

(21) Appl. No.: 10/491,407

(22) PCT Filed: Sep. 27, 2002

(86) PCT No.: PCT/EP02/10876

§ 371 (c)(1),
(2), (4) Date: Apr. 1, 2004

(87) PCT Pub. No.: WO03/038218

PCT Pub. Date: May 8, 2003

(65) Prior Publication Data

US 2005/0005398 A1 Jan. 13, 2005

(30) Foreign Application Priority Data

Oct. 30, 2001 (DE) ..... 101 52 436
Dec. 14, 2001 (DE) ..... 101 61 645

(51) Int. Cl.
*E05D 11/10* (2006.01)

(52) U.S. Cl. ..... 16/287; 16/282; 16/294; 16/302; 16/366; 16/368; 16/369; 16/286; 16/DIG. 43

(58) Field of Classification Search ..... 16/282, 16/287, 294, 302, 366, 368, 389, 369, 370, 16/286
See application file for complete search history.

(56) References Cited

U.S. PATENT DOCUMENTS

| | | | | |
|---|---|---|---|---|
| 4,388,745 | A * | 6/1983 | Schneider et al. | 16/288 |
| 4,470,169 | A * | 9/1984 | Lautenschlager et al. | 16/291 |
| 4,558,485 | A | 12/1985 | Rock et al. | |
| 4,596,062 | A * | 6/1986 | Rock | 16/304 |
| 4,736,491 | A * | 4/1988 | Mertes | 16/358 |
| 4,837,894 | A * | 6/1989 | Lin | 16/288 |

FOREIGN PATENT DOCUMENTS

| | | |
|---|---|---|
| DE | 835 714 | 7/1949 |
| DE | 935 349 | 11/1955 |
| DE | 39 15 502 A1 | 11/1990 |
| EP | 0 027 481 A1 | 4/1981 |
| FR | 1 508 270 | 11/1966 |
| GB | 413393 | 7/1934 |
| GB | 2 163 480 A | 2/1986 |

* cited by examiner

*Primary Examiner*—Robert J. Sandy
*Assistant Examiner*—Marcus Menezes
(74) *Attorney, Agent, or Firm*—Sughrue Mion, PLLC

(57) ABSTRACT

A hinge for connecting a first folding element to a second folding element. The hinge includes a fixing element which comprises a first fixing face by means of which the fixing element is contactingly fixable to the second folding element; a first arm connected to the fixing element so as to be pivotable around a first pivot axis between a first position and a second position; a second arm having a fixing device by which the second arm can be fixed to the second folding element, and is connected to the first arm so as to be pivotable around a second pivot axis extending parallel to the first pivot axis between a first position and a second position. In the first position, the first arm encloses a smallest angle relative to the fixing face and, in the second position, encloses a greatest angle relative to the fixing face.

11 Claims, 8 Drawing Sheets

HINGE

The invention relates to a hinge for folding flaps or folding doors which comprise a first and a second folding element which, for the purpose of opening the folding flap or folding door, can be pivoted relative to one another. In a closed position, the folding elements are positioned on a common plane and each comprise an abutment edge, which abutment edges are arranged parallel relative to one another.

Such hinges comprise a first fixing element which is firmly attached to a surface of the first folding element, and a second fixing element which is firmly attached to a surface of the second folding element. The two fixing elements are pivotably connected to one another around a pivot axis which extends along the abutment edges of the folding elements. Such folding flaps and folding doors which can be folded asymmetrically are subject to problems, i.e. their pivot axes do not extend closely to the abutment edges, but with reference to the surface of one of the folding elements, said pivot axes are arranged so as to be offset relative to the abutment edges. In prior art hinges, one arm of the first fixing element in the folding element plane projects beyond the respective abutment edge. At the free end of the arm, the first fixing element is pivotably connected to the second fixing element. The distance between the pivot axis and the abutment edge of the first folding element is approximately the same as from the second folding element. Therefore, when opening the folding flap or folding door, there occurs a gap between the two folding elements. Said gap constitutes a source of danger during the closing operation, because the hand of a person may be caught in the gap.

It is the object of the present invention to provide a hinge which can be used for asymmetrically divided folding flaps or folding doors, without the user being at risk of being injured when the folding flap or folding door is closed.

In accordance with the invention, the objective is achieved by providing a hinge for connecting a first folding element to a second folding element of a folding flap or folding door, comprising

- a fixing element which comprises a first fixing face by means of which it can be contactingly fixed to the first folding element;
- a first arm
  - which is connected to the fixing element so as to be pivotable around a first pivot axis between a first position and a second position;
- a second arm
  - which comprises fixing means by means of which the second arm can be fixed to the second folding element, and
  - which is connected to the first arm so as to be pivotable around a second pivot axis extending parallel to the first pivot axis between a first position and a second position,
- wherein, in the first position, the first arm encloses a smallest angle relative to the fixing face and, in the second position, encloses a greatest angle relative to the fixing face, and
- wherein, in the first position, the first arm and the second arm enclose the smallest angle and, in the second position, the greatest angle relative to one another.

When said hinge is used in a folding flap or in a folding door it is thus possible—starting from a closed position in which the two folding elements are positioned on one common plane, with the first arm being in its first position and the second arm in its first position—for the abutment edge of the first folding element to be moved away from the second folding element, with the first arm being transferred into its second position and being slightly pivoted relative to the second arm. There thus occurs a gap between the abutment edge of the first folding element and the abutment edge of the second folding element. When closing the folding flap or folding door, said gap can be retained in the closed position without injuring the person whose hand had entered the gap.

To ensure that, in the normal condition of the closed position, i.e. when a person's hand is not caught and when, in consequence, there is no gap between the folding elements, the two folding elements are arranged in a common plane, the first arm is loaded by spring means towards its first position.

For this purpose, the first arm can be provided with a formed-on lever which starts from the first pivot axis and which is supported by a spring element against the fixing element. To delimit the pivot path of the first arm to its second position, the lever is used as a stop which acts against the fixing element.

A simple hinge design, more particularly when the hinge consists of plastics, can be achieved in that the first arm is connected by a film hinge to the fixing element. A separate spring element can be avoided in that the film hinge is designed to be resilient and thus serves as a spring element.

In order to ensure a defined sequence of movements when opening and closing the folding flap or folding door, the fixing element comprises a setting contour, with the first arm being associated with a setting slide which, on the one hand, is resiliently supported against the first arm and, on the other hand, is slidingly supported by means of a setting face against the setting contour and with the setting slide, in the first position of the first arm, engaging an engagement indentation in the setting contour. When the first arm carries out pivot movements relative to the fixing element, the setting slide, by means of its setting face, thus slides on the setting contour. As the setting slide in the first position of the first arm engages the engagement indentation, the first arm is held in its first position. During normal sequences of movement during the opening or closing operations of the folding flap or folding door, the first arm is securely held in its first position. Only when the user places his hand between the first folding element and the second element while the folding flap or folding door is being closed, is the first arm moved out of its first position, with the setting slide being moved out of the engagement indentation against a spring force.

It can be proposed that the setting contour—starting from the engagement indentation as far as the point of contact achieved between the setting slide and the setting contour when the first arm is transferred into its second position—is positioned at a constant distance from the first pivot axis. In this way it is ensured that the setting slide only needs to be displaced when being moved out of the engagement indentation against a spring force. During the further movement of the first arm towards the second position, the setting slide is not moved any further against the spring force, so that no torque is applied to the first arm.

To ensure a defined end stop of the second arm, it is proposed that, in the second position of the first arm, the setting slide is in contact with an end stop of the setting contour.

In a preferred embodiment, the second fixing means are provided in the form of a second fixing face by means of which the second arm can be secured to the second folding element.

As a rule, the first fixing face and the second fixing face are arranged on a common plane when the first arm is in its first position and the second arm in its second position.

Preferred embodiments will be explained in greater detail below with reference to the drawings wherein FIG. 1 is a perspective exploded view of an inventive hinge.

FIG. 1 shows the individual components of an inventive hinge in an exploded view and FIG. 2 shows the inventive hinge in a mounted condition. FIGS. 1 and 2 will be described jointly below.

Figure 1:
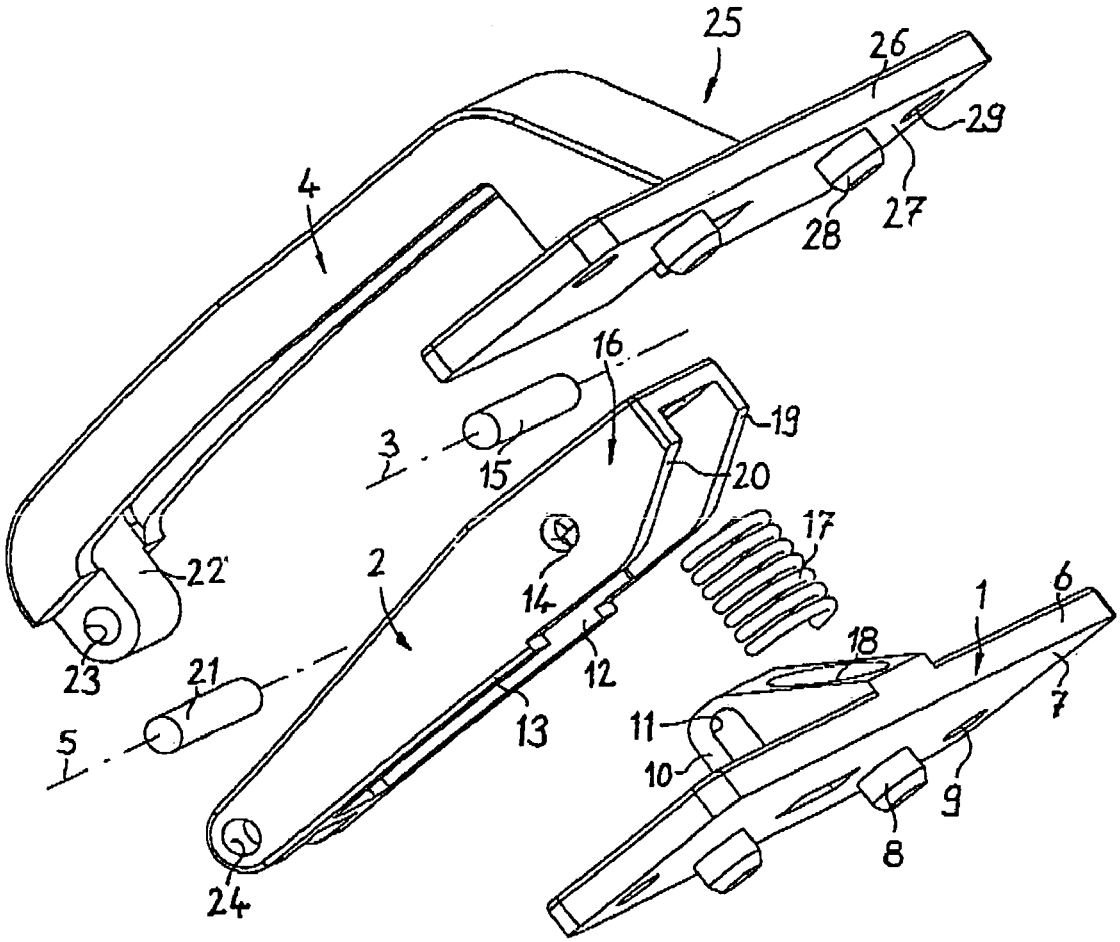

The hinge comprises a fixing element 1 to which a first arm 2 is pivotably secured around a first pivot axis 3. A second arm 4 is connected to the first arm 2 so as to be pivotable around a second pivot axis 5.

The fixing element 1 comprises a first fixing plate 6 which forms a first fixing face 7. The fixing element 1 can be fixed to a first folding element of a folding flap or folding door, with the first fixing face 7 resting against a surface of the first folding element. To prevent the fixing element 1 from rotating on the surface of the first folding element, there are formed on securing projections 8 which start from the first fixing face 7 and which can enter a bore in the first folding element. For the purpose of securely fixing the fixing element 1, the first fixing plate 6 additionally comprises through-bores 9 through which fixing screws can be passed. Furthermore, the fixing element 1, on its side facing away from the first fixing face 7, comprises an articulated projection 10 which is provided with an aperture 11.

The first arm 2 has a U-shaped profile, and in a mounted condition of the first arm 2, a first leg 12 and a second leg 13 of the U-shaped profile enclose the articulated projection 10. The first leg 12 and the second leg 13 are each provided with a bore 14, which bores 14 are aligned with the aperture 11 in the articulated projection 10. An articulated pin 15 is positioned in the bores 14 and in the aperture 11, so that the first arm 2 and the fixing element 1 are pivotably connected to one another. The first arm 2 is provided with a formed-on lever 16 which starts from the bores 14 which are arranged coaxially relative to the first pivot axis 3. A spiral spring 17 is supported against the lever 16 on the one hand and against the fixing element 1 on the other hand. The spiral spring 17 is guided inside the a bore 18 in the articulated projection 10 and is supported on the base of the bore 16. The first arm 2 is thus loaded towards a first position in which the first arm encloses a smallest angle relative to the first fixing face 7. From this position, the first arm 2 can be transferred against the spring force of the spiral spring 17 into a second position in which the first arm 2 encloses a greatest angle relative to the fixing face 7. Like the entire first arm 2, the lever 16 is U-shaped and forms supporting faces 19, 20 which, in the second position of the first arm 2, are supported against the first fixing plate 6. The pivot path of the first arm 2 is thus delimited.

The second arm 4 comprises a connecting portion 22 provided with a bore 23. The bore 23 extends coaxially relative to the second pivot axis 5. The first leg 12 and the second leg 13 of the first arm 2 enclose the connecting portion 22, with bores 24 in the two legs 12, 13 being aligned with the bore 23 in the connecting portion 22. In the bores 24 and in the bore 23, there is arranged a second articulated pin 21, so that the first arm 2 and the second arm 4 are pivotably connected to one another. In the position as illustrated, the second arm 4 is in a first position relative to the first arm 2, in which position the first arm 2 and the second arm 4 enclose the smallest angle relative to one another. At an end remote from the connecting portion 22, the second arm 4 comprises a fixing portion 25 which comprises a second fixing plate 26 forming a second fixing face 27. The second arm 4 can be fixed by means of the second fixing plate 26 to a second folding element of the folding flap or folding door, with the second fixing face 27 resting against a surface of the second folding element. For the purpose of preventing the second arm 4 from rotating, there are formed on securing projections which start from the second fixing face 27 and which, in the mounted condition of the hinge, project into bores of the second folding element. The fixing plate 26 can be screwed by screws to the second folding element, with the screws being guided through through-bores 29 in the second fixing plate 26.

Figure 2:
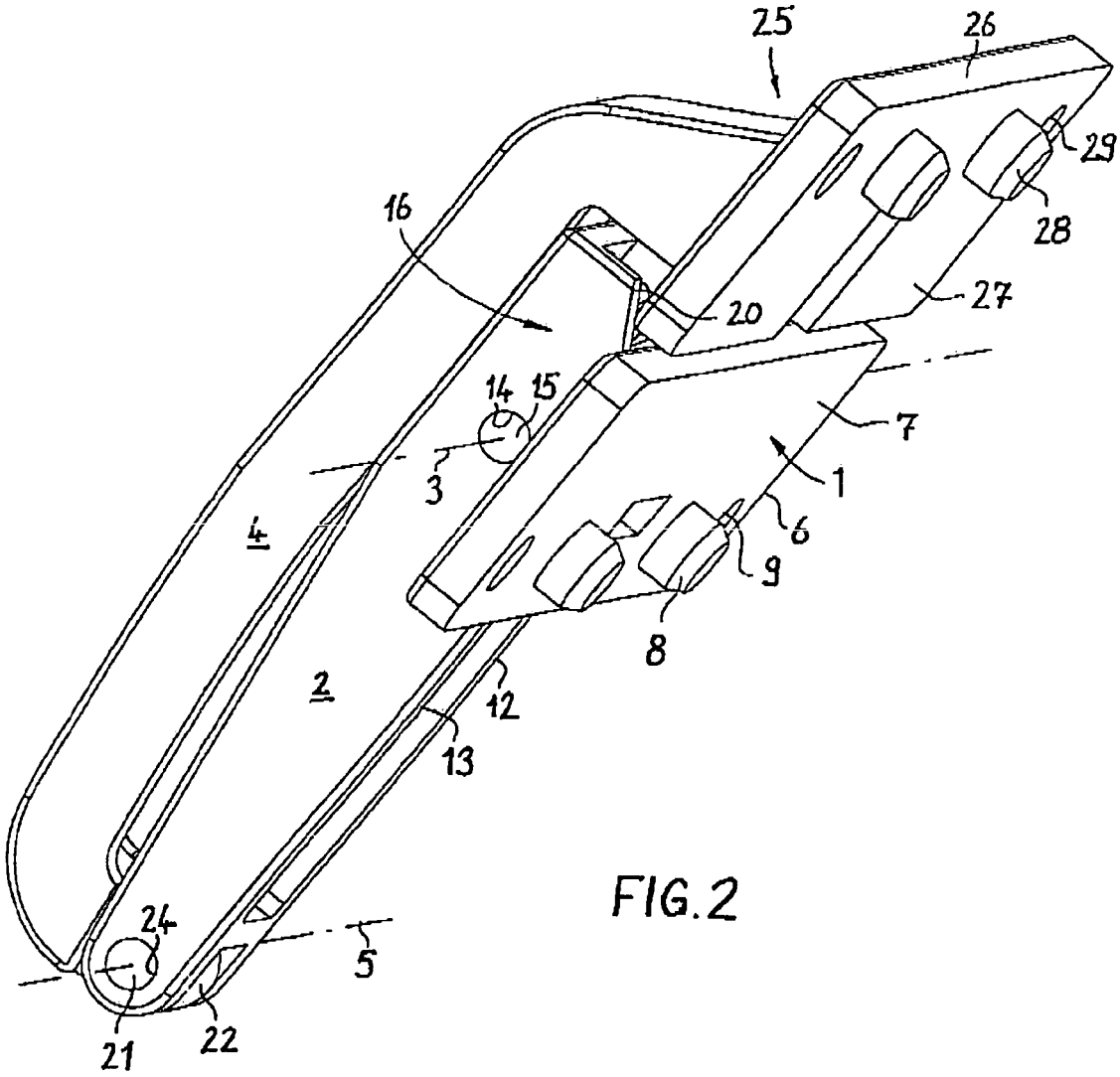
FIG. 2 is a perspective illustration of a hinge according to FIG. 1 in a mounted condition.
Figure 3:
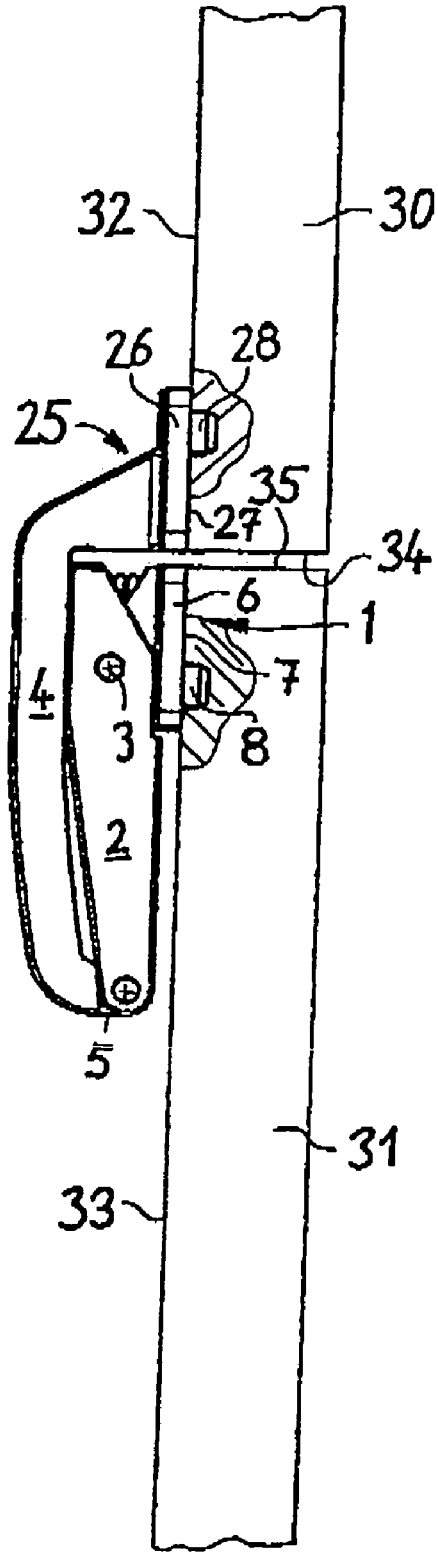
FIG. 3 is a side view of the hinge according to FIG. 1, with the closed position being in a normal condition.

FIG. 3 shows a folding flap with a first folding element 30 and a second folding element 31 which are arranged vertically one above the other. At its vertical upper end, the first folding element 30 is pivotably connected to a body of a piece of furniture. A hinge according to FIGS. 1 and 2 is secured to a first surface 32 of the first folding element 30. Corresponding components of the hinge have been given the same reference numbers and are described in FIGS. 1 and 2. The second fixing face 27 of the second fixing plate 26 rests against the first surface 32 in a planar way. The fixing element 1 is fixed to a second surface 33 of the second folding element 31. The first fixing face 7 of the fixing element 1 rests against a second surface 33 of the second folding element 31 in a planar way. In the position shown in FIG. 3, the folding elements 31 and 32 are in a normal condition of the closed position, with the first fixing face 7 and the second fixing face 27 being positioned on a common plane. As a result of the design of the hinge, the second pivot axis 5 is arranged at a distance from a first abutment edge 34 of the first folding element 30 and from a second abutment edge 35 of the second folding element 31. The two abutment edges 34, 35 of the folding elements 30, 31 extend parallel relative to one another. In conventional hinges, the pivot axis is positioned approximately at the level of the two abutment edges of the folding elements.

Figure 4:
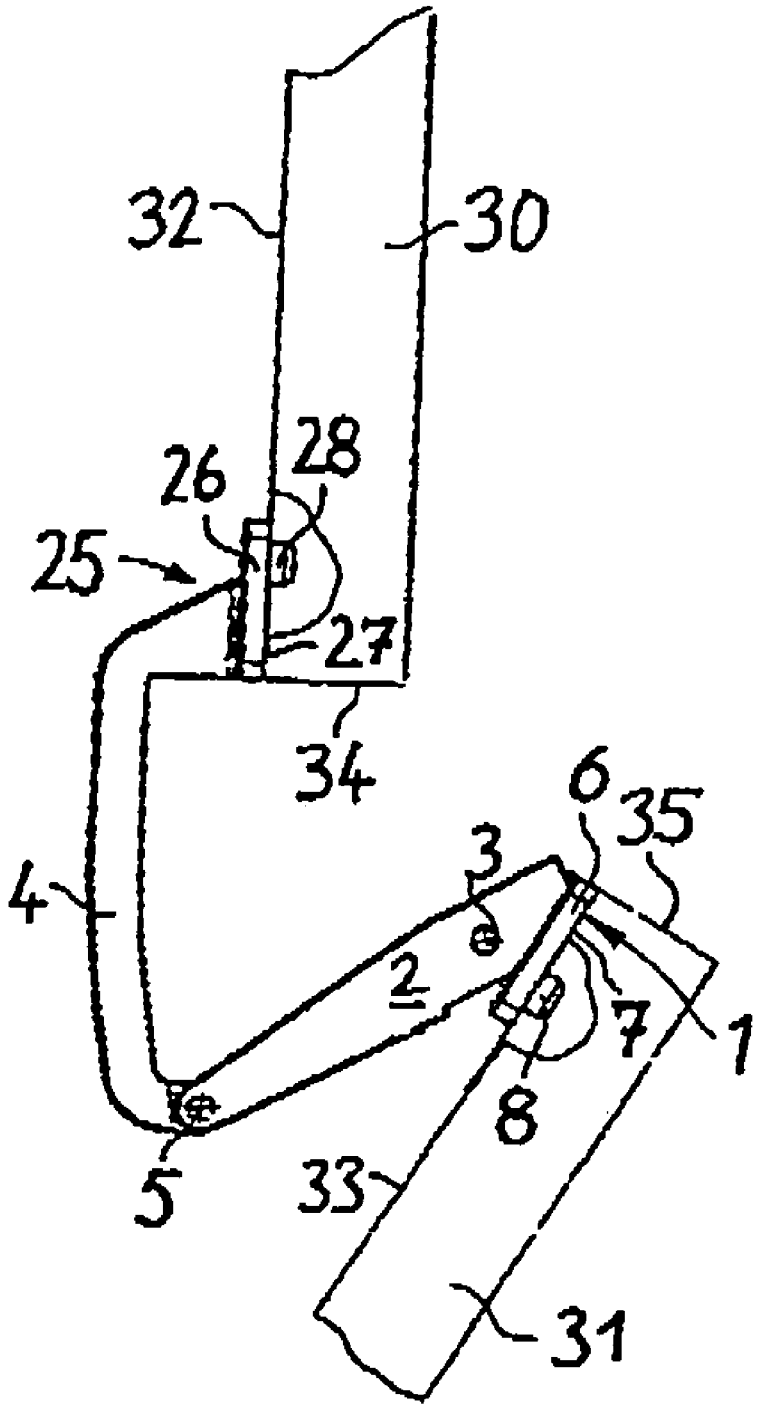
FIG. 4 is a side view of a hinge according to FIG. 1, with the closed position being protected against jamming.

FIG. 4 shows the folding flap according to FIG. 3 in a closed position which has an anti-catching effect. The first folding element 30 is in the same position as shown in FIG. 3. Only the first arm 2 is transferred into its second position in which it encloses the greatest angle relative to the first fixing face 7 of the fixing element 1.

Furthermore, the first arm 2 and the second arm 4 are in an intermediate position relative to one another in which the two arms 2, 4 enclose a greater angle relative to one another than shown in FIG. 3. The fixing face 7 of the fixing element 1 and the fixing face 27 of the second fixing element 26 are thus arranged at an angle relative to one another, just like the first surface 32 of the first folding element 30 and the second surface 33 of the second folding element 31. Between the two abutment edges 34, 35, of the folding elements 30, 31, there is thus produced a gap which is large enough to allow the user to place his fingers into said gap without being injured.

Figure 5:
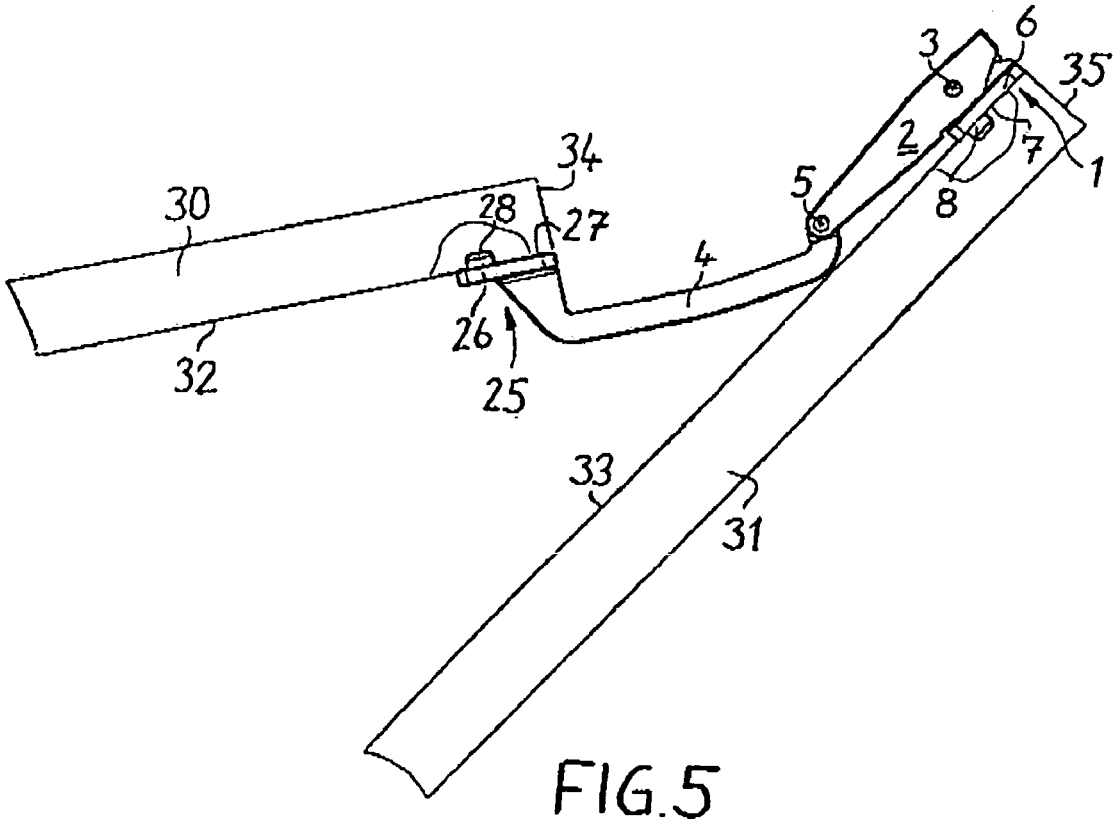
FIG. 5 is a side view of the hinge according to FIG. 1 in the open position.

FIG. 5 shows the folding flap according to FIG. 3 in an open position. In this open condition, the first arm 2 is in its first position in which it assumes the same angular position relative to the fixing element 1 as in the closed position according to FIG. 3. Relative to the first arm 2, the second arm 4 is in its second position in which the two arms 2, 4 assume the greatest angle relative to one another. The second folding element 31 is thus folded around the pivot axis 5 towards the first folding element 30, with the first folding element 30 being pivoted upwardly around the pivot axis around which it is connected to the body of the piece of furniture.

Figure 6:
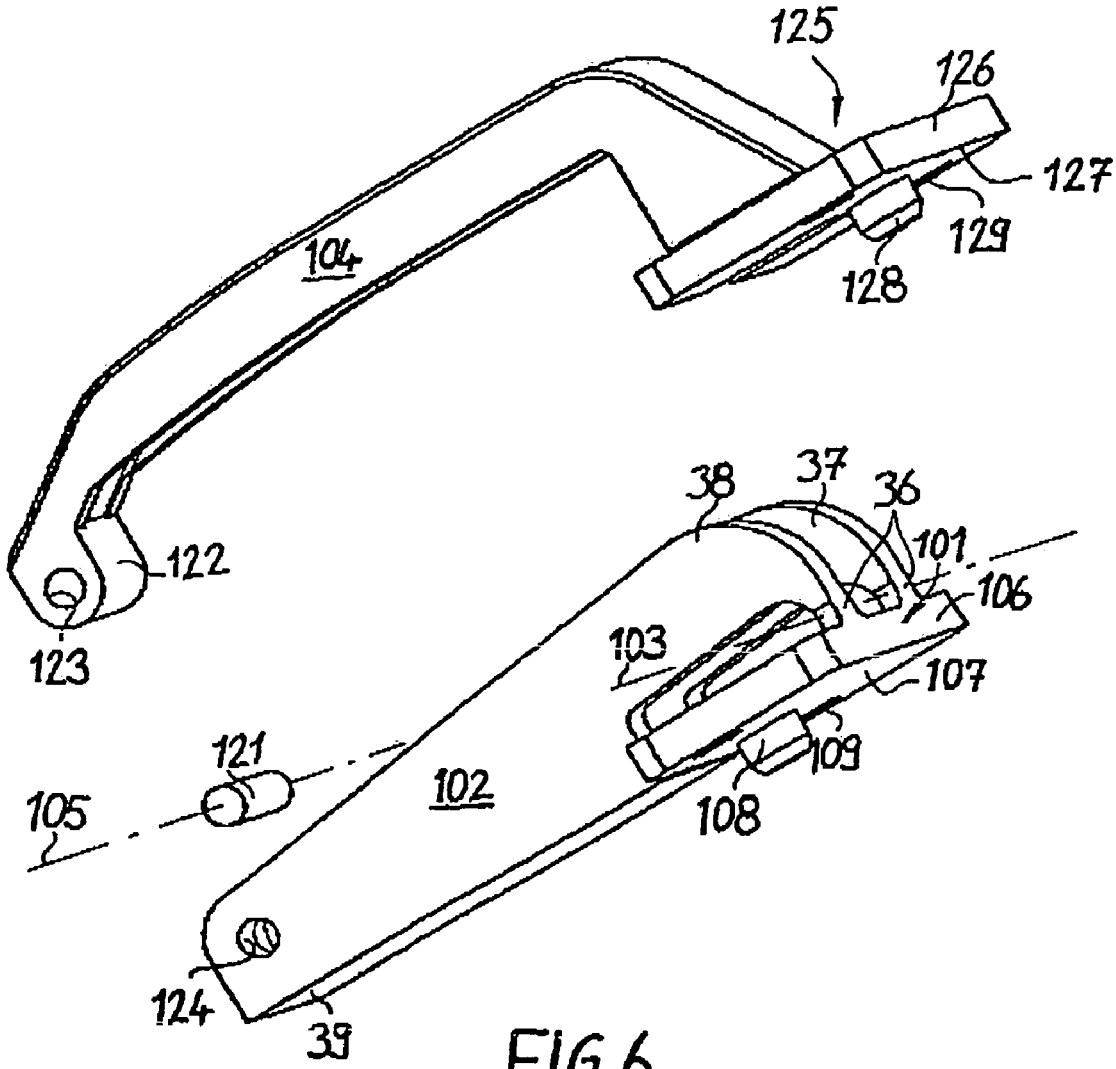
FIG. 6 is a perspective exploded view of a hinge with a film hinge between the first arm and the fixing element.
Figure 7:
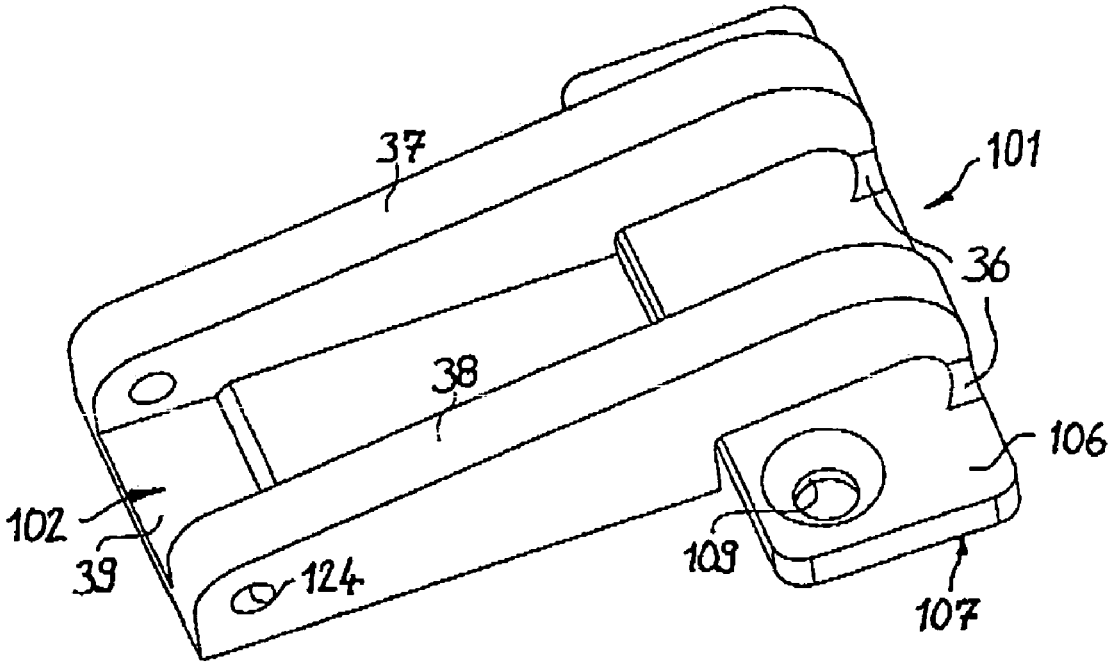
FIG. 7 is a perspective view of the first arm of the hinge according to FIG. 6.

FIG. 6 shows a second embodiment of the hinge. Any components which correspond to any components of the hinge according to FIGS. 1 to 5, have been given reference numbers which are increased by the value 100 and are described in connection with FIGS. 1 to 5. Below, FIG. 6 will be described together with FIG. 7 which shows the first arm 102 in a different perspective.

In contrast to the hinge according to FIGS. 1 to 5, the fixing element 101 and the first arm 102 are produced in one piece. The fixing element 101 and the first arm 102 are integrally connected to one another via film hinges 36. On the one hand, the film hinges 36 serve to articulatingly connect the first arm 102 to the fixing element 101. On the other hand, the film hinge 36 is designed to be resilient, so that the first arm 102 is loaded towards its first position.

Furthermore, the first arm 102 comprises a first rib 37 and a second rib 38 which are each connected via the film hinges 36 to the fixing element 101 and which are spaced in the direction towards the second pivot axis 5. Furthermore, the first rib 37 and the second rib 38 are connected to one another by a web 39. The first rib 37, the second rib 38 and the web 39 thus form a recess which can be entered by the second arm 104 in its first position. The second arm 104 is pivotably connected to both the first rib 37 and to the second rib 38 of the first arm 102. There is thus achieved an embodiment which, starting from the first fixing face 107, comprises a shorter height. Furthermore, the components can be produced from plastics.

Figure 8:
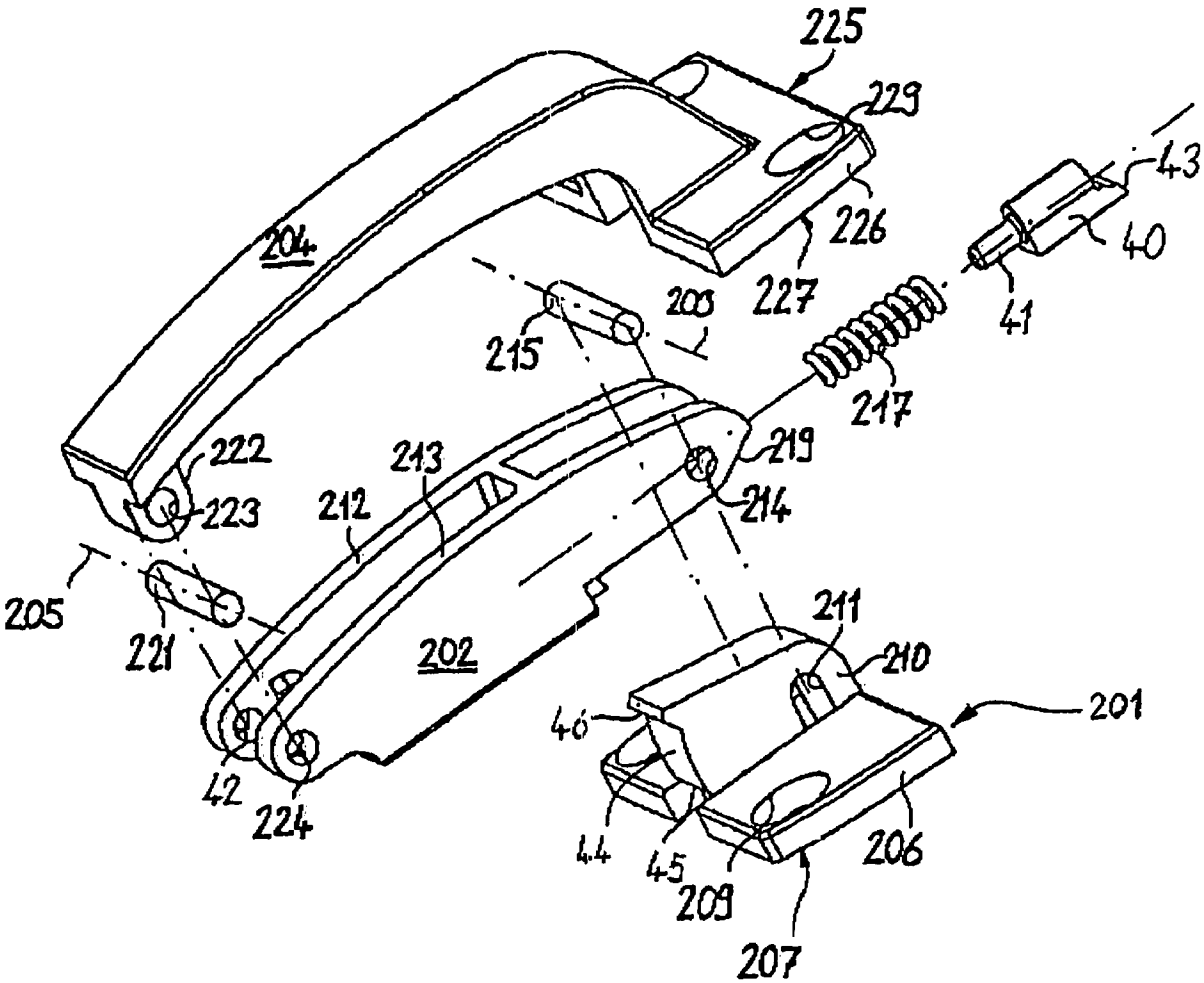
FIG. 8 is a perspective exploded view of a further embodiment of an inventive hinge.

FIG. 8 shows the individual parts of a further embodiment of an inventive hinge in an exploded view. Any components which correspond to the components of the hinge according to FIG. 1 have been given reference numbers whose value has been increased by 200 and are described in connection with FIG. 1.

A setting slide 40 is displaceably guided in the first arm 202 and is supported via a spiral spring 217 against the second arm 204. For this purpose, the setting slide 40 is provided with a centering projection 41 which is guided into the windings of a spiral spring 217. Furthermore, the setting slide 40 comprises a setting face 43 by means of which the setting slide 40, via the spiral spring 217, is supported against a setting contour 44 of the fixing element 201. In the first position of the first arm 202, the setting slide 40, by means of its setting face 43, engages an engagement indentation 45. When the first arm 202 is moved out of its first position towards its second position, the setting slide 40 has to be moved against the spring force of the spiral spring 217 out of the engagement indentation 45 and in the process, it is moved to part of the setting contour 44, with the distance from the first pivot axis 203 being greater. Starting from the engagement indentation 45, the setting contour 44 comprises a constant distance from the first pivot axis 203, so that, when the first arm 202 is pivoted towards the second position, the setting slide 40 does not have to be moved against the spring force of the spiral spring 217, so that no torque is applied to the first arm 202. In the second position of the first arm 202, the setting slide 40 is in contact with an end stop 46 of the setting contour.

LIST OF REFERENCE NUMBERS 1, 101, 210 fixing element
2, 102, 202 first arm
3, 103, 203 first pivot axis
4, 104, 204 second arm
5, 105, 205 second pivot axis
6, 106, 206 first fixing plate
7, 107, 207 first fixing face
8, 108 securing projection
9, 109, 209 through-bore
10, 210 articulated projection
11, 211 aperture
12, 212 first leg
13, 213 second leg
14, 214 bore
15, 215 first articulated pin
16 lever
17, 217 spiral spring
18 bore
19, 219 supporting face
20 supporting face
21, 121, 221 second articulated pin
22, 122, 222 connecting portion
23, 123, 223 bore
24, 124, 224 bore
25, 125, 225 fixing portion
26, 126, 226 second fixing plate
27, 127, 227 second fixing face
28, 128 securing projection
29, 129, 229 through-bore
30 first folding element
31 second folding element
32 first surface
33 second surface
34 first abutment edge
35 second abutment edge
36 film hinge
37 first rib
38 second rib
39 web
40 setting slide
41 centering projection
42 bore
43 setting face
44 setting contour
45 engagement indentation
46 end stop

The invention claimed is:

1. A hinge for a folding flap including a first folding element and a second folding element which, in a closed position, are arranged on a common vertical plane, for connecting the first folding element with the second folding element, comprising:

a fixing element which comprises a first fixing face by means of which the fixing element is contactingly fixed to the second folding element;

a first arm which is connected to the fixing element at a first end of the first arm so as to be pivotable around a first pivot axis relative to the fixing element between a first position of rotation about the first pivot axis and a second position of rotation about the first pivot axis;

a second arm which comprises a fixing means by means of which the second arm is fixed to the first folding element, and which is connected to the first arm so as to be pivotable around a second pivot axis relative to the first arm at a second end of the first arm extending parallel to the first pivot axis between a first position of rotation about the second pivot axis and a second position of rotation about the second pivot axis, wherein, the first arm, in the first position of rotation about the first pivot axis, which is assumed in the closed position and in an open position for closing and opening of a foldable cover, encloses a first angle relative to the fixing face, the first arm in the second position of rotation about the first pivot axis, which is assumed in an intermediate position for moving the foldable cover between the closed position and the open position, encloses a second angle relative to the fixing face, which is greater than the first angle, in the first position of rotation about the second pivot axis of the second arm, which is assumed in the closed position, the first arm and the second arm encloses a third angle relative to one another, and in the second position of rotation about the second pivot axis of the second arm, which is assumed in the open position, the first arm and the second arm encloses a fourth angle relative to one another, which is greater than the third angle.

2. A hinge according to claim 1, wherein the first arm is loaded by a spring means towards its first position.

3. A hinge according to claim 2, wherein the fixing means includes a second fixing face by means of which the second arm is fixed to the second folding element.

4. A hinge according to claim 1, wherein the fixing element comprises a setting contour, wherein the first arm is associated with a setting slide which, on the one hand, is resiliently supported against the first arm and, on the other hand, by means of a setting face, is slidingly supported against the setting contour, and wherein in the first position of the first arm, the setting slide engages a engagement indentation of the setting contour.

5. A hinge according to claim 4, wherein starting from the engagement indentation up to the point of contact achieved by the setting slide with the setting contour when the first arm is transferred into its second position, the setting contour comprises a constant distance from the first pivot axis.

6. A hinge according to claim 5, wherein in the second position of the first arm, the setting slide is in contact with an end stop of the setting contour.

7. A hinge according to claim 6, wherein the fixing means includes a second fixing face by means of which the second arm is fixed to the second folding element.

8. A hinge according to claim 4, wherein the fixing means includes a second fixing face by means of which the second arm is fixed to the second folding element.

9. A hinge according to claim 5, wherein the fixing means includes a second fixing face by means of which the second arm is fixed to the second folding element.

10. A hinge according to claim 1, wherein the fixing means includes a second fixing face by means of which the second arm is fixed to the second folding element.

11. A hinge according to claim 10, wherein in the first position of the first arm and in the first position of the second arm, the first fixing face and the second fixing face are arranged on a common plane.

* * * * *